US009795974B2

(12) United States Patent
Zhou et al.

(10) Patent No.: US 9,795,974 B2
(45) Date of Patent: Oct. 24, 2017

(54) BUTTON SWITCHING SHOWER AND ITS SWITCHING METHOD

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Huasong Zhou, Fujian (CN); Jianmin Chen, Fujian (CN); Renzhong Li, Xiamen (CN); Bin Chen, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 0 days.

(21) Appl. No.: 15/217,045

(22) Filed: Jul. 22, 2016

(65) Prior Publication Data

US 2016/0325291 A1 Nov. 10, 2016

Related U.S. Application Data

(62) Division of application No. 13/577,869, filed on Aug. 8, 2012, now Pat. No. 9,427,749.

(51) Int. Cl.

| | |
|---|---|
| ***B05B 1/14*** | (2006.01) |
| ***B05B 1/16*** | (2006.01) |
| ***B05B 1/18*** | (2006.01) |

(52) U.S. Cl.

CPC ..... *B05B 1/169* (2013.01); *B05B 1/1636* (2013.01); *B05B 1/1654* (2013.01); *B05B 1/18* (2013.01); *Y10T 137/86863* (2015.04)

(58) Field of Classification Search

CPC ..... B05B 1/16; B05B 1/1654; B05B 1/1663; B05B 1/18; B05B 12/002

USPC ..... 239/443, 444, 446–449, 558, 559, 562, 239/563, 567, 569, 390–392, 394

See application file for complete search history.

(56) References Cited

U.S. PATENT DOCUMENTS

| | | | | |
|---|---|---|---|---|
| 5,215,258 | A * | 6/1993 | Jursich | B05B 1/1636 239/394 |
| 5,433,384 | A | 7/1995 | Chan et al. | |
| 6,622,945 | B1 | 9/2003 | Wu et al. | |
| 7,080,795 | B2 | 7/2006 | Chen | |

(Continued)

FOREIGN PATENT DOCUMENTS

| | | |
|---|---|---|
| CN | 1127679 A | 7/1996 |
| CN | 2564258 Y | 8/2003 |

(Continued)

*Primary Examiner* — Alexander Valvis

(74) *Attorney, Agent, or Firm* — Rabin & Berdo, P.C.

(57) ABSTRACT

A switching method of a button switching shower includes: step 1, pressing a button slidingly connected to the shower, and then the button slides; step 2, the button acts on the linking seat of the pawl for rotating the pawl; step 3, the pawl rotates the ratchet wheel through the control end of the pawl, and the shape of the elastic claw of the pawl is changed for restoring energy; step 4, the rotation of the ratchet wheel rotates the water diversion disc, and then the water diversion disc is in place, and then the water diversion disc switches the outlet functions, the stopping claw of the pawl is against the ratch of the ratchet wheel for stopping the ratchet wheel inversion; step 5, the pressing is loosened for resetting the button, and the elastic energy of the elastic claw is released for resetting the pawl.

2 Claims, 10 Drawing Sheets

(56) References Cited

U.S. PATENT DOCUMENTS

| | | | |
|---|---|---|---|
| 7,694,359 | B1 | 4/2010 | Hall |
| 8,020,786 | B2 | 9/2011 | Lo |
| 8,573,512 | B2 | 11/2013 | Hu |
| 2005/0258274 | A1 | 11/2005 | Wang |
| 2006/0157583 | A1 | 7/2006 | Huang |

FOREIGN PATENT DOCUMENTS

| | | | |
|---|---|---|---|
| CN | 1891347 | A | 1/2007 |
| CN | 101844117 | A | 9/2010 |
| CN | 201586577 | U | 9/2010 |
| JP | 2002194782 | A | 7/2002 |

* cited by examiner

A-A

D-D

C-C

BUTTON SWITCHING SHOWER AND ITS SWITCHING METHOD

FIELD OF THE INVENTION

The present invention relates to a shower, more particularly to a button switching shower and its switching method.

BACKGROUND OF THE INVENTION

There are three kinds of shower switching structure in the market: button switching, rotary switching and swing switching. Among there, a positioning mechanism is arranged in all the three kinds of switching structure and used for maintaining the switching status. Because of the arrangement of the positioning mechanism, a plurality of defects is present: 1 the structure of the shower is complex with great processing difficulty and cost; 2 the assembly is complicated with low efficiency.

SUMMARY OF THE INVENTION

The object of the present invention is to offer a button switching shower and its switching method, which overcomes the complex structure and complicated assembly of the switching structure at the prior art.

One of the technical proposals to solve the technical matter in the present invention is:

Button switching shower, which comprises a fixed unit and a switching mechanism and at least two outlet functions are arranged in the fixed unit, The switching mechanism comprises a button that is slidingly connected to the fixed unit;

A pawl that is rotationally connected to the fixed unit, is provided with a linking seat and a control end, and a transmission connection relationship is formed by the linking seat and the button, so that the button can act on the linking seat for driving the pawl rotate;

A ratchet wheel that is rotationally connected to the fixed unit, is connected to the control end of the pawl, so that the control end of the pawl can act on the ratchet wheel for driving the ratchet wheel rotate;

A water diversion disc that is rotationally arranged in the fixed unit, a synchronous rotation connection relationship is formed by the water diversion disc and the ratchet wheel, so that the ratchet wheel can drive the water diversion disc rotate, and the switching of the outlet functions is achieved by the relative rotation of the water diversion disc to the fixed unit.

In a preferred embodiment, the pawl is also provided with a stopping claw of which the end is against the ratch of the ratchet wheel.

In a preferred embodiment, the pawl is also provided with an elastic claw that is clamped between the two limited posts that are arranged in the fixed unit for resetting the pawl.

In a preferred embodiment, the button is provided with an outer end that is extended outside for the user's pressing and an inner end that is in the fixed unit; a transmission mechanism is arranged between the button and the linking seat of the pawl, the transmission mechanism comprises:

A deviator that is pivotally arranged in the fixed unit, is provided with a pivot joint part, and a pushing groove and an ejector rod are arranged at the two sides of the pivot joint part, and the ejector rod is adaptive to the inner end of the button, so that the inner end of the button can act on the ejector rod for driving the deviator rotate;

A connecting rod, two end of the connecting rod are against the pushing groove of the deviator and the linking seat of the pawl respectively, and the movement of the pushing groove can be transmitted to the movement of the linking seat through the connecting rod.

In a preferred embodiment, the fixed unit comprises a body, a water diversion body and a outlet terminal, the outlet terminal is fixedly connected below the body with a plurality of outlet functions, the water diversion body is connected to the clearance between the body and the outlet terminal, and a cylindrical inlet cavity that is communicated with the water resource is formed by the water diversion body and the body;

The water diversion holes one-to-one corresponding to the outlet functions are arranged in the part of the water diversion body corresponding to the cylindrical inlet cavity, and an outlet hole is arranged on the water diversion disc;

The water diversion disc is rotationally mounted in the cylindrical inlet cavity, the water diversion disc and the water diversion body can be hermetically connected to each other and rotate relatively, one of several groups of the water diversion holes and the inlet cavity are communicated with the outlet hole through the rotation of the water diversion disc.

In a preferred embodiment, a synchronizing shaft is convexly arranged on the water diversion disc, and the synchronizing shaft passes through the body hermetically; the ratchet wheel is connected to the synchronizing shaft to form a synchronous rotation connection relationship between the ratchet wheel and the water diversion disc.

In a preferred embodiment, the fixed unit also comprises a top cover that covers and connects to the body.

Another technical proposal to solve the technical matter in the present invention is:

The switching method of the button switching shower, it comprises:

Step 1, the button that is slidingly connected to the shower is pressed, and then the button slides relatively;

Step 2, the button acts on the linking seat of the pawl for driving the pawl rotate;

Step 3, the rotation of the pawl drives the ratchet wheel rotate through the control end of the pawl, and the shape of the elastic claw of the pawl is changed for restoring energy at the same time;

Step 4, the rotation of the ratchet wheel drives the water diversion disc rotate, and then the water diversion disc is in place, and then the switching of the outlet functions is achieved by the water diversion disc, the stopping claw of the pawl is against the ratch of the ratchet wheel for stopping the inversion of the ratchet wheel at the same time;

Step 5, the pressing is loosened for resetting the button, and the elastic energy of the elastic claw is released for resetting the pawl.

Compared with the technical proposal at the prior art, the pawl is driven to rotate by pressing the button, the rotation of the ratchet wheel is controlled by the rotation of the pawl, the ratchet wheel drives the water diversion disc rotate, and then the switch of the outlet functions is achieved by the rotation between the water diversion disc and the fixed unit. It overcomes the defects at the prior art and has the following advantages: lunilateral rotating is achieved by the ratchet wheel for automatic positioning; 2 the switching status can be maintained by the cooperation of the stopping claw; 3 different from the traditional face cover swivel switching method, the switching of the outlet functions is conveniently achieved by just pressing button lightly; 4 the structure is stable, the switching force is low, and the switching feeling is good; 5 the resetting of the pawl is achieved by the cooperation of the elastic claw and the limited posts; 6 the sliding of the button is transmitted to the rotating of the pawl through the cooperation of the deviator and the connecting rod with simple transmission structure, small space occupation and low pressing force; 7 the axis accuracy of the rotation of the water diversion disc is guaranteed by the water diversion disc that is rotationally arranged in the circular assembly slot of the water diversion body; 8 the tightness is guaranteed by the inlet cavity that is formed by the circular assembly slot and the body together; 9 the top cover covers the body for containing the pawl and the ratchet wheel with good sealing property and outline.

REFERENCE SIGN

Figure 1:
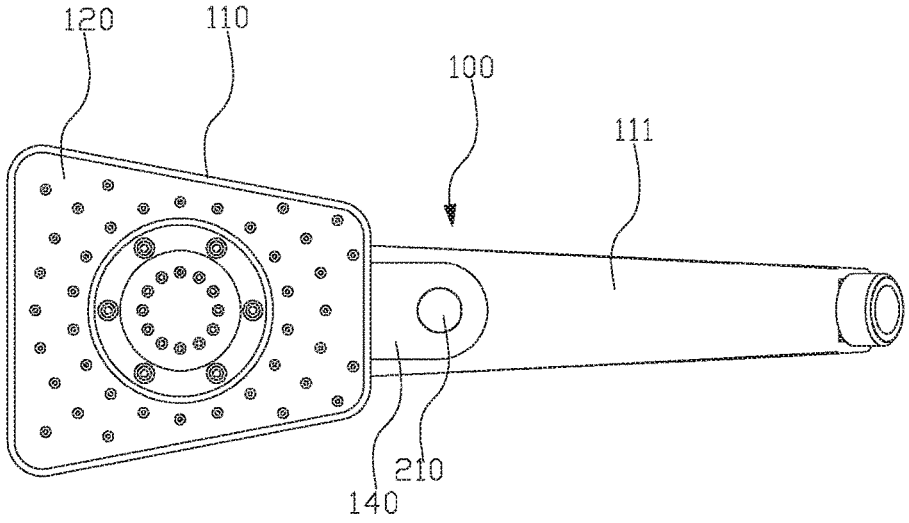
FIG. 1 shows the front view of the shower in the present invention.
Figure 2:
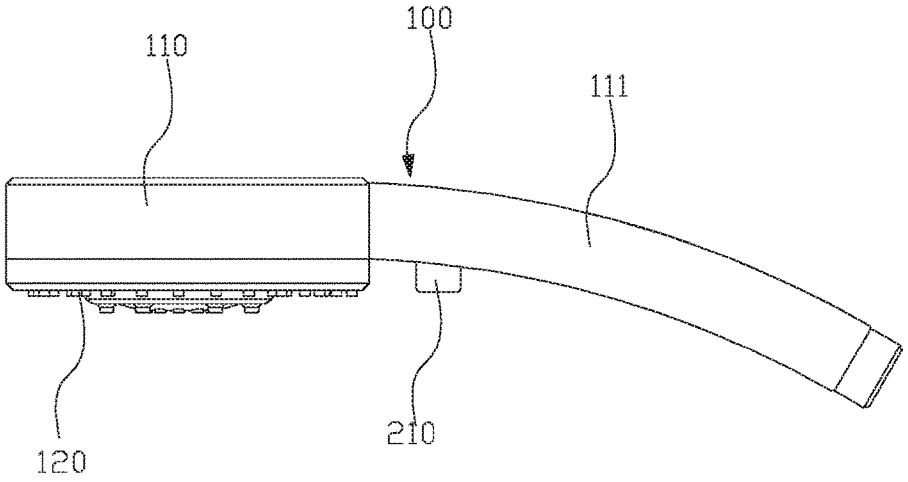
FIG. 2 shows the upward view of the shower in the present invention.
Figure 3:
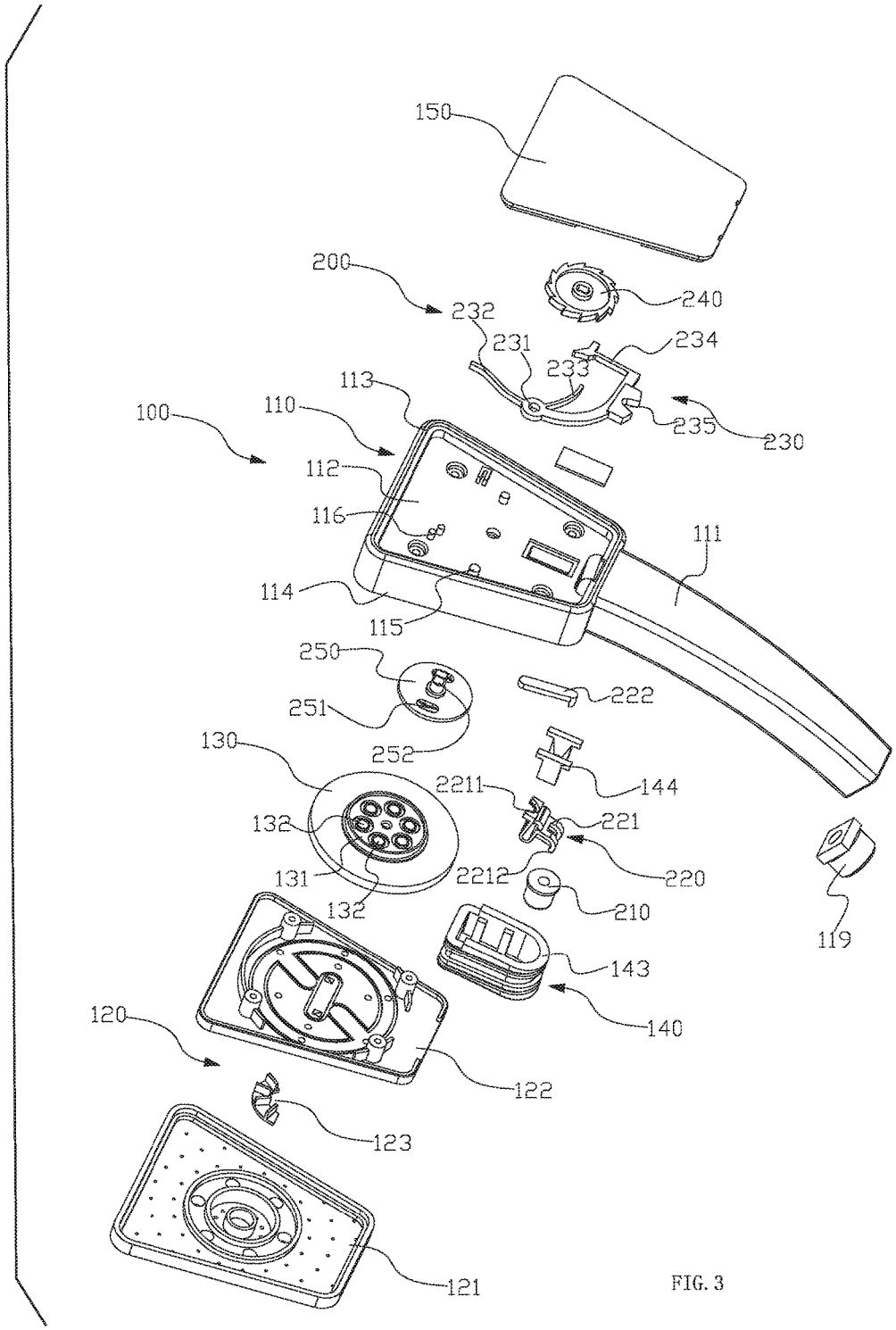
FIG. 3 shows one of the exploded views of the shower in the present invention.
Figure 4:
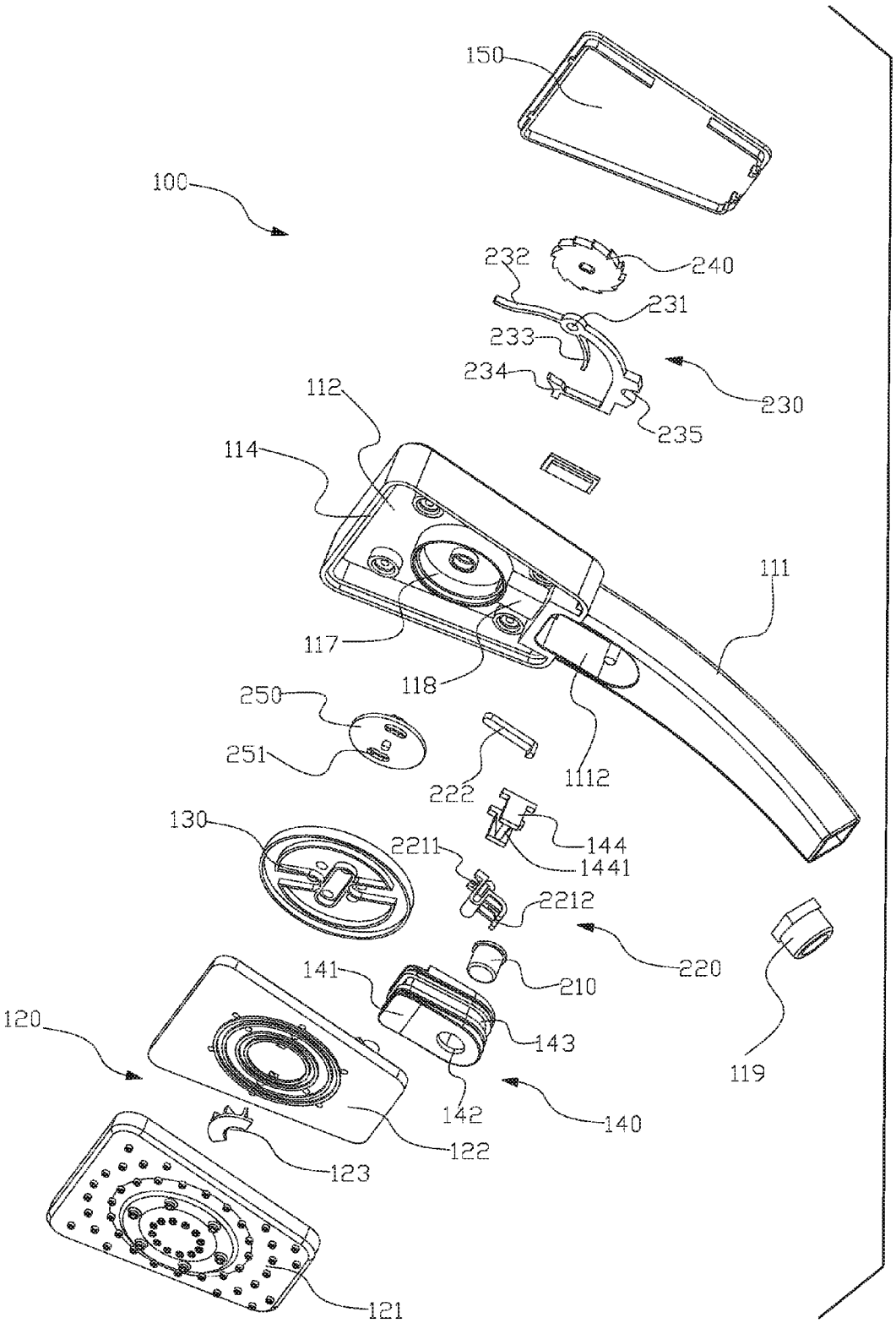
FIG. 4 shows another exploded view of the shower in the present invention.
Figure 5:
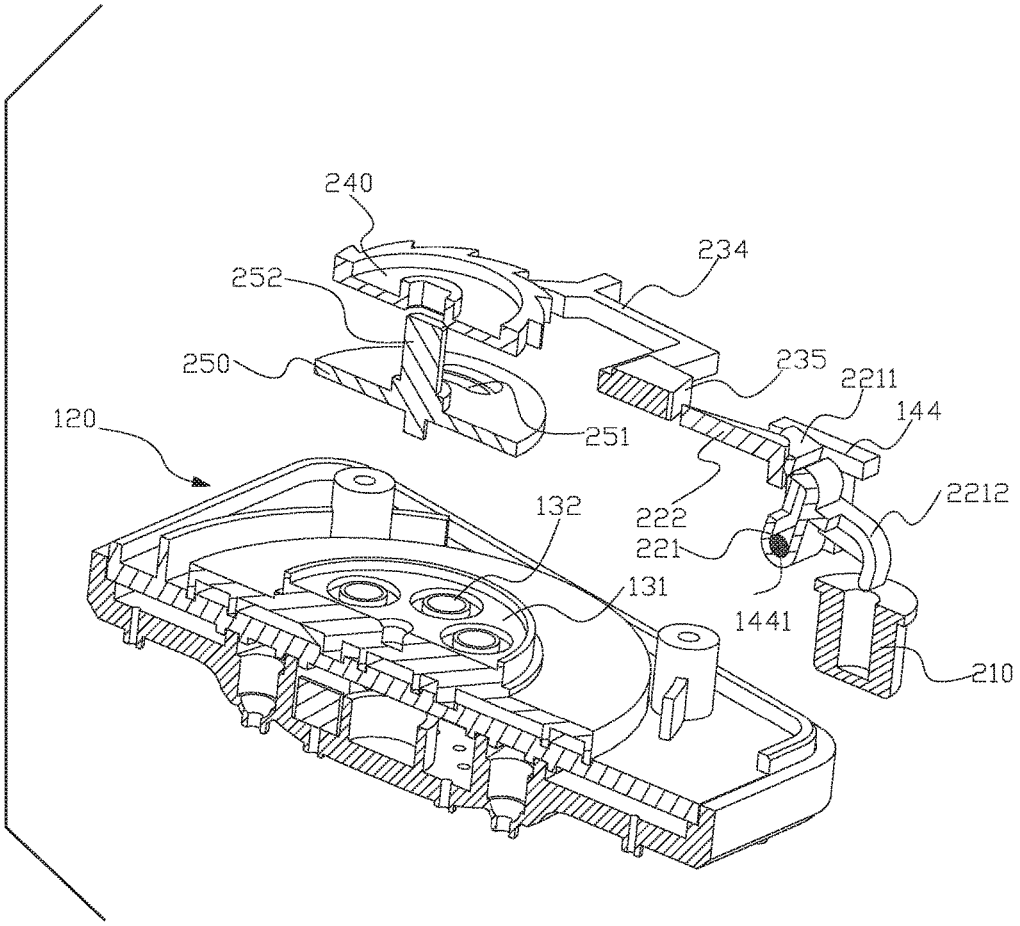
FIG. 5 shows the partial solid semi-sectional view of the shower in the present invention.

Fixed unit 100, switching mechanism 200, body 110, outlet terminal 120, water diversion body 130, a button seat 140, top cover 150, handle 111, sealing plate 112, upper surrounding wall 113, lower surrounding wall 114, hollow hole 1111, boss 115, limited post 116, cylindrical surrounding wall 117, communicating channel 118, connector 119, mounting hole 1112, face cover 121, water diversion welding cover 122, impeller 123, cylindrical set 131, water diversion hole 132, bottom plate 141, sliding hole 142, encircling wall 143, bearing 144, button 210, transmission mechanism 220, pawl 230, ratchet wheel 240, water diversion disc 250, outlet hole 251, synchronizing shaft 250, pivot hole 231, elastic claw 232, stopping claw 233, controlling claw 234, linking seat 235, deviator 221, connecting rod 222, pushing groove 2211, ejector rod 2212.

DESCRIPTION OF THE PREFERRED EMBODIMENTS

With the following description of the drawings and specific embodiments, the invention would be further described in details.

The button switching shower according to FIG. 1 to FIG. 4, it comprises a fixed unit 100 and a switching mechanism 200, and at least two outlet functions are arranged in the fixed unit 100.

According to FIG. 1 to FIG. 4, the fixed unit 100 comprises a body 110, an outlet terminal 120, a water diversion body 130, a button seat 140 and a top cover 150.

A handle 111, a sealing plate 112 that is fixed to the front of the handle 111, an upper surrounding wall 113 that is upward extended from the periphery of the sealing plate 112, and a lower surrounding wall 114 that is downward extended from the periphery of the sealing plate 112 are provided witch the body 110; the handle 110 is hollow with a hollow hole 111 communicated with the water resource; a boss and two interval limited posts 116 are convexly arranged above the sealing plate 112; a cylindrical surrounding wall 117 and a communicating channel 118 are convexly arranged below the sealing plate 112, one of the end of the communicating channel 118 is communicated with the hollow hole 1111 of the handle 111, another end of the communicating channel 118 is arranged on the internal revolution surface of the cylindrical surrounding wall 117, so that the water of water resource flows into the cylindrical surrounding wall 117. A mounting hole 112 is opened up below the handle 111 of the body 110. The handle 111 is connected to the water resource through the connector 119.

The outlet terminal 120 comprises a face cover 121, a water diversion welding cover 122 and a impeller 123, three rounding sealing walls are fixedly arranged on the face cover 121, the water diversion welding cover 122 is welded above the face cover 121, so that three independent cavities are formed between the three rounding sealing walls and the surrounding wall of the face cover 121, the impeller 123 is arranged in the cavity that is formed between the first and the second rounding sealing wall, when water collides the impeller 123, water comes out of the outlet hole in the cavity intervally so that the massage effect is achieved; different water outlets are arranged respectively in the face cover 121 corresponding to the three dependent cavities, so that different outlet functions are achieved under the cooperation of the independent cavities and water outlets. In the present embodiment, the outlet terminal 120 is provided with three outlet functions, but without limitation, other ways such as two or four outlet functions is also applied to the present embodiment.

The outlet terminal 120 is fixedly arranged below the body 110 and is hermetically connected to the lower surrounding wall 114 of the body 110.

The water diversion body 130 is hermetically fixed between the body 110 and the outlet terminal 120. A cylindrical set 131 is convexly arranged on the water diversion body 130, and the water diversion holes 132 with the same amount of the outlet functions are opened up on the water diversion body 130. In the present embodiment, three groups of water diversion holes 132 are present with two water diversion holes in each group. The inlet of the water diversion holes 132 is configurationally and circularly arranged on the top surface of the cylindrical set 131, and the outlets of the water diversion holes 132 are communicated with the cavities of the outlet terminal 120 respectively. The cylindrical set 131 of the water diversion body 130 is adaptive and hermetically connected to the internal revolution surface of the cylindrical surrounding wall 117, so that a cylindrical inlet cavity that is communicated with the water resource through the hollow hole 1111 of the handle 111 and the communicating channel 118 is formed under the cooperation of the sealing plate 112, the water diversion body 130 and the cylindrical surrounding wall 117.

The button seat 140 is hermetically fixed to the mounting hole 1112 of the handle 111 and the body 110, the button seat 140 comprises a bottom plate 141, a sliding hole 142 opened up in the bottom plate 141, and a encircling wall 143 extended upward from the periphery of the bottom plate 141. Two bearings 144 are fixedly arranged in the button seat 140, and the two bearings 144 are parallel to each other and are connected through the pivot.

The top cover 150 is hermetically connected to the upper surrounding wall 113 of the body 110 for containing the connecting rod 222 of the transmission mechanism 200, the pawl 230 and the ratchet wheel 240.

According to FIG. 3 to FIG. 11, the switching mechanism 200 comprises a button 210, a transmission mechanism 220, a pawl 230, a ratchet wheel 240 and a water diversion disc 250.

The water diversion disc 250 is adaptive to and rotationally mounted in the cylindrical surrounding wall 117 of the body 110, and the water diversion disc 250 is hermetically connected to and can rotate relative to the top surface and bottom surface of the cylindrical set 131 of the water diversion body 130, namely is adaptive to and rotationally mounted between the body 110 and the water diversion body 130, and namely is adaptive to and rotationally mounted in the cylindrical inlet cavity. A group of outlet holes 251 are opened up on the water diversion disc 250, the outlet holes 251 are communicated with the inlet cavity, and one of the three groups of water diversion holes 132 through the relative rotation of the water diversion disc 250 and water diversion body 130. A synchronizing shaft 252 is fixedly arranged on the water diversion disc 250, which comprises a lower cylindrical segment and an upper non-circular segment. The synchronizing shaft 252 is passed through the sealing plate 112 of the body 110, wherein, the cylindrical segment is adaptive to the sealing plate so that the synchronizing shaft 252 can rotate relative to the sealing plate 112, the non-circular segment is extended upwards from the sealing plate 112 of the body 110.

The ratchet wheel 240 is arranged above the sealing plate 112 and is adaptively connected to the non-circular segment of the synchronizing shaft 252 of the water diversion disc 250, so that a synchronous rotation connection relationship is formed by the ratchet wheel 240 and the water diversion disc 250. As needed, a fixed connection relationship or a one piece relationship can also be formed by the ratchet wheel 240 and the water diversion disc 250.

The pawl is provided with a pivot hole 231, a elastic claw that is fixedly arranged in the pivot hole 231, a stopping claw 233 that is fixedly arranged in the pivot hole 231, a impending segment that is fixedly arranged in the pivot hole 231, a controlling claw 234 that is fixedly arranged at the end of the impending segment, and a linking seat 235 that is fixedly arranged at the back of the impending segment. The pivot hole 231 is pivotally connected to the boss 115 of the sealing plate 112 of the body 110, so that the pawl 230 can rotate relative to the boss 115. The elastic claw 232 is adaptive to and passes through the clearance between the two limited posts 116 of the sealing plate 112 of the body 110. Wherein, the end of the controlling claw 234 is against the ratchets of the ratchet wheel 240 for pushing the end of the controlling claw 234, so that the ratchet wheel can be driven to rotate forward; the end of the stopping claw 233 is against the ratchets of the ratchet wheel 240 for stopping the reversal of the ratchet wheel through the end of the stopping claw 233; the elastic claw 232 is clamped between the two limited posts 116 for restoring energy when the pawl 230 rotate forward.

The transmission mechanism 220 comprises a deviator 221 and a connecting rod 222. The deviator 221 is provided with a pivot joint part, a pushing groove 2211 and an ejector rod 2212 that are arranged at the two sides of the pivot joint part, and the pivot joint part is drivingly connected to the clearance between the two bearings 144 of the button seat 140, so that the deviator 211 can rotate relative to the pivot 1441 after external force acting on the deviator. The connecting rod 220 is against between the pushing groove 2211 of the deviator 221 and the linking seat 235 of the pawl 230, so that the rotation of the deviator 221 can push the connecting rod 222 for driving the movement of the linking seat 235, and then push the pawl 230 forward; oppositely, the movement of the linking seat 235 can drive the pushing groove 2211 move through the connecting rod 222, and then drive the deviator 221 rotate.

The button 210 is slidingly connected to the sliding hole 142 of the button seat 140 of the fixed unit 140, and is provided with an outer end that is extended out of the bottom plate 141 of the button seat 140 for the user's pressing and an inner end that is in the button seat 140. The inner end of the button 210 and the ejector rod 2212 are against to each other, so that the sliding of the button 210 can drive the deviator rotate through the ejector rod 2212, and oppositely, the rotation of the deviator 221 can drive the button 210 slide through the ejector rod 2212.

Figure 6:
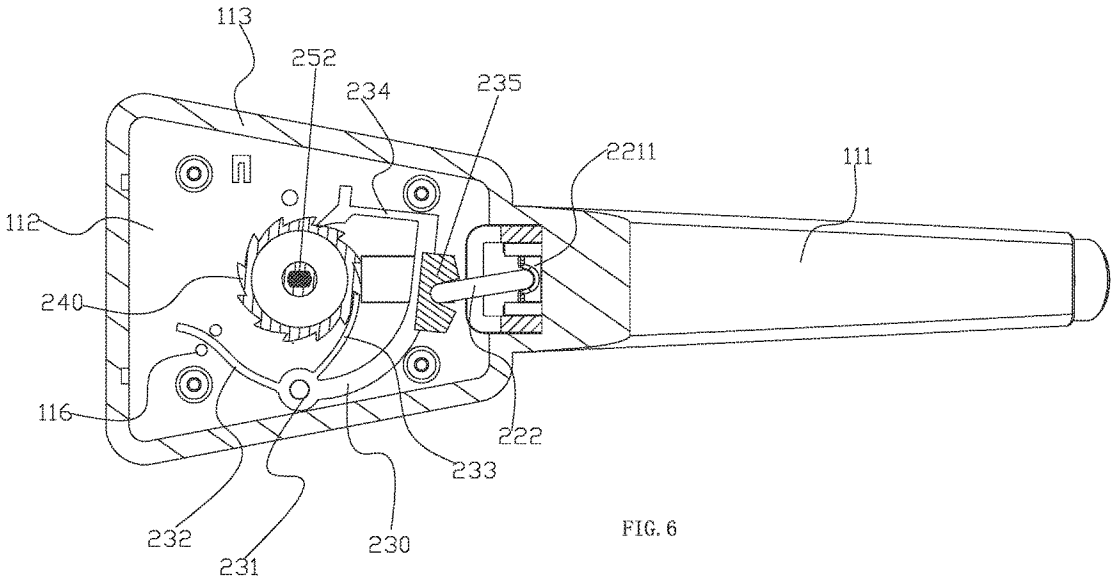
FIG. 6 shows the abridged general view of the shower in the present invention without top cover, water comes out of the first outlet function of the shower.
Figure 7:
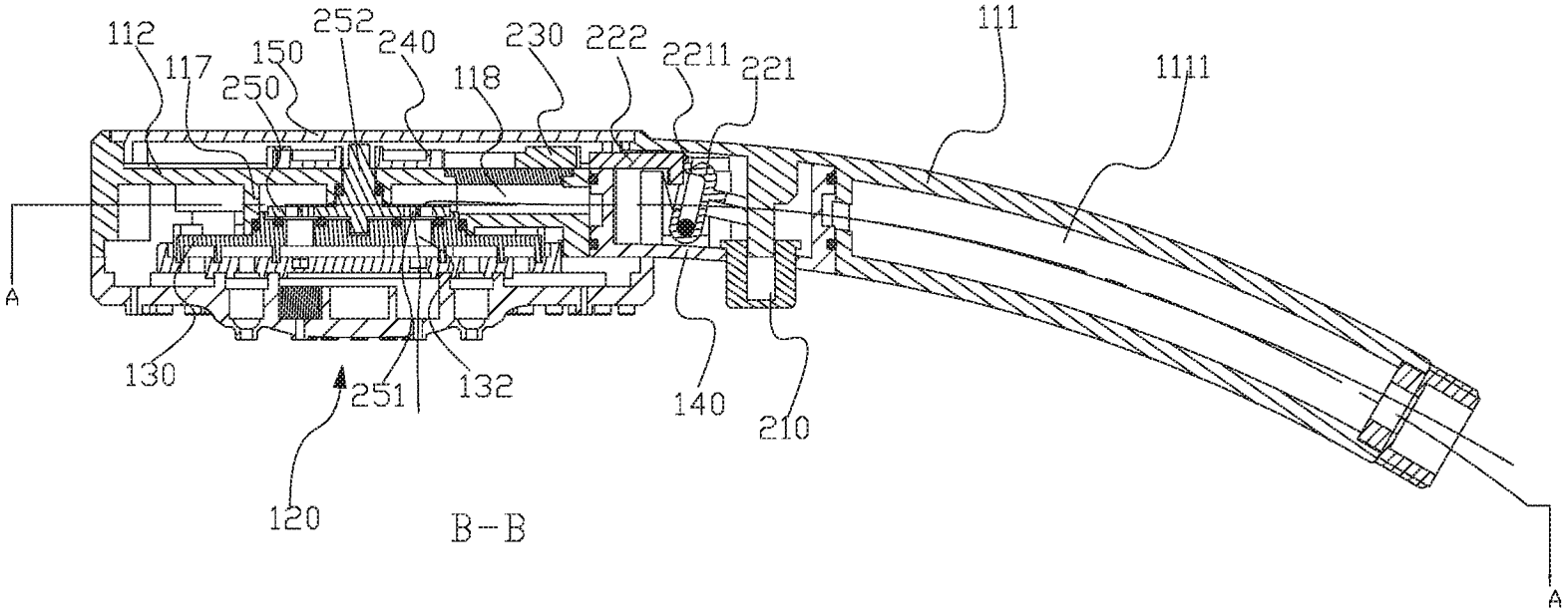
FIG. 7 shows the cutaway view of FIG. 8 B-B.
Figure 8:
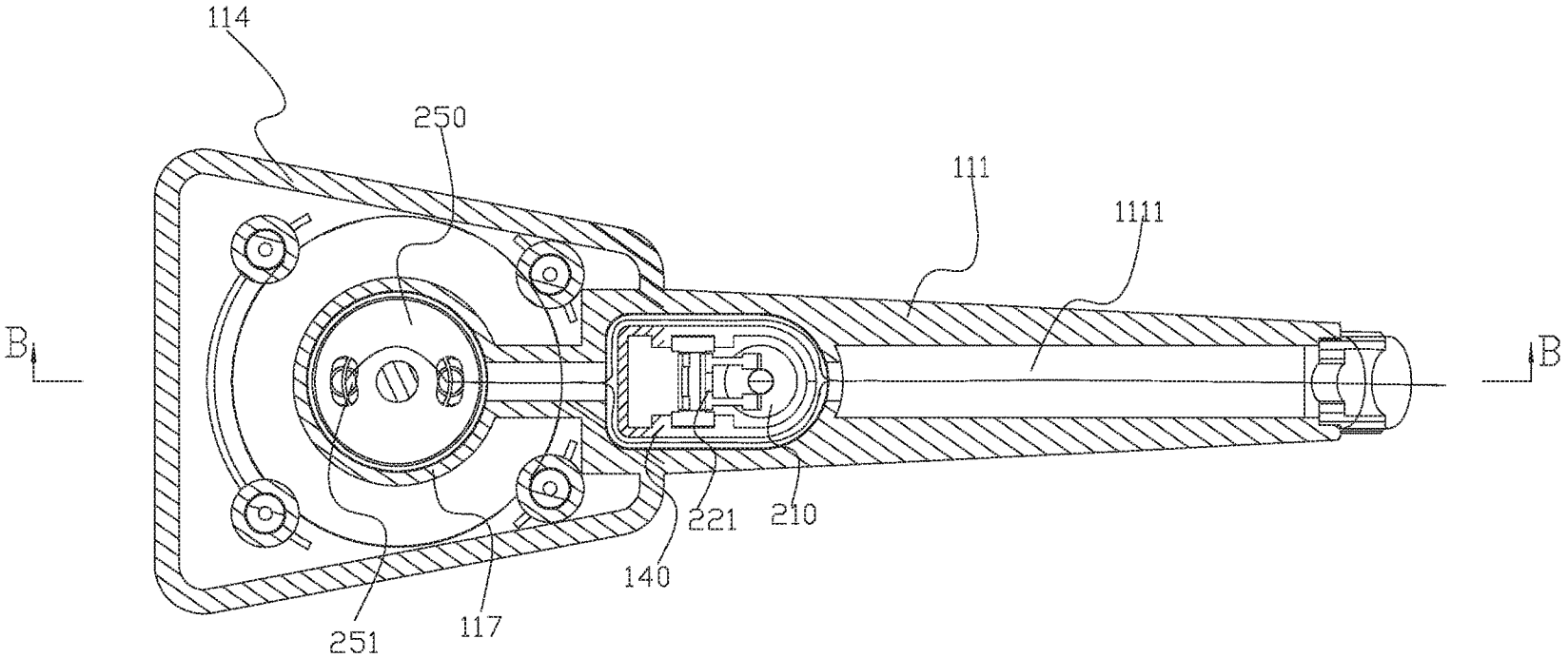
FIG. 8 shows the cutaway view of FIG. 7 A-A.

The switching method of the button switching shower, it comprises:

Step 0 Water comes out of the first outlet function of the shower, the outlet hole 251 of the water diversion disc 250 is aligned at and communicated with the first water diversion hole 132, according to FIG. 6, FIG. 7 and FIG. 8, water flows along the water resource, the hollow hole 1111 of the handle 111, the communicating channel 118, inlet cavity, outlet hole 251, the first water diversion hole 132 and the first cavity in rotate at the moment.

Step 1 The button 210 that is slidingly connected to the shower is pressed and then the button 210 slides relatively.

Step 2 The inner end of the button 210 is against the ejector rod 2212 of the deviator and push the ejector rod 2212, and then push the deviator 221 rotate, and then drive the pushing groove 2212 move, and then the linking seat 23 of the pawl 230 is driven through the connecting rod 220, and then the pawl 230 rotates.

Step 3 The pawl 230 rotates and drives the ratchet wheel 240 rotate through the end of the controlling claw 234 of the pawl 230, and at the same time, the elastic claw 232 of the pawl 240 is out of shape to restore energy owing to the two limited post.

Figure 9:
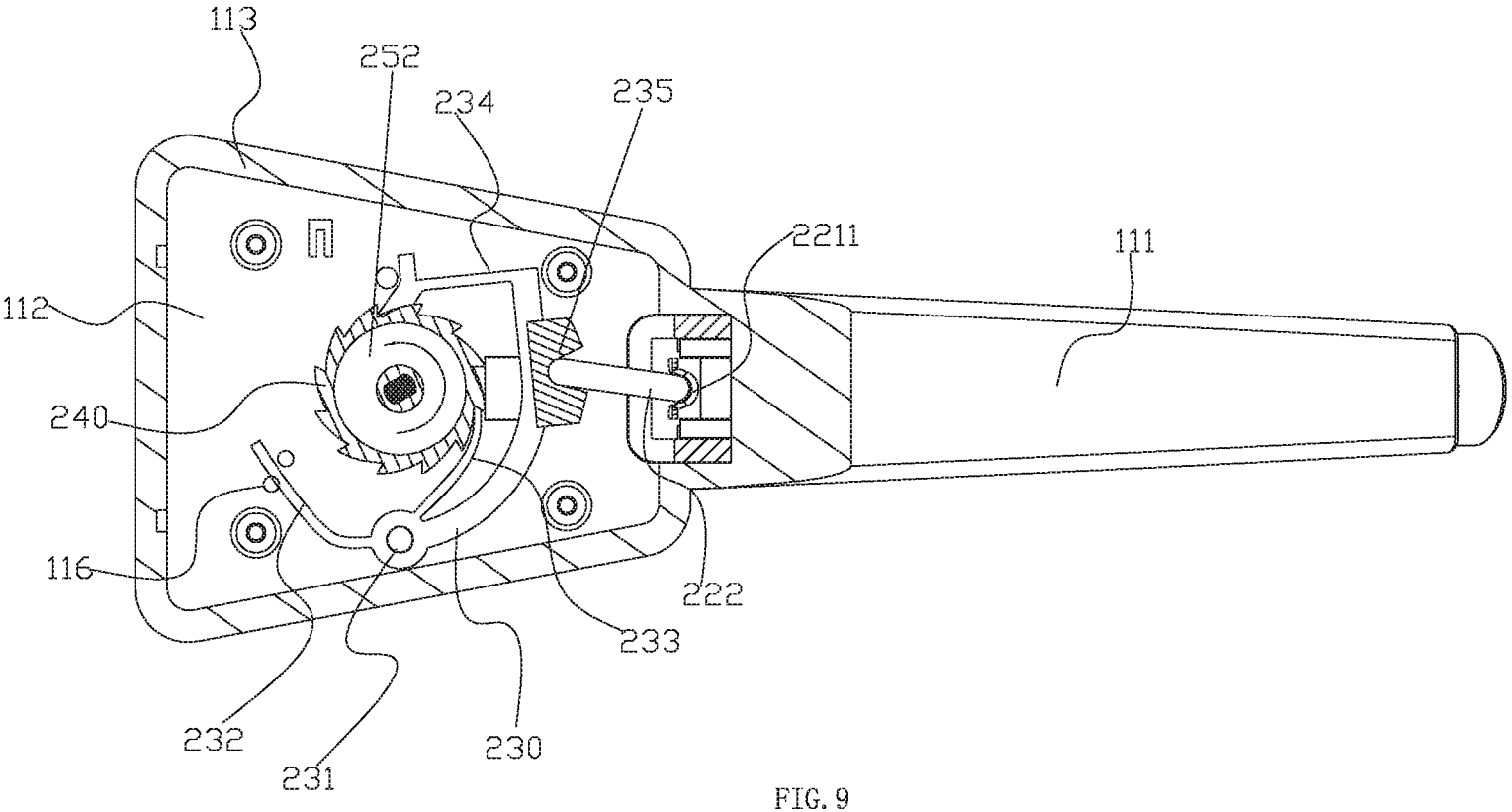
FIG. 9 shows the abridged general view of the shower in the present invention without top cover, water comes out of the second outlet function of the shower, and the pawl is still not reset.
Figure 10:
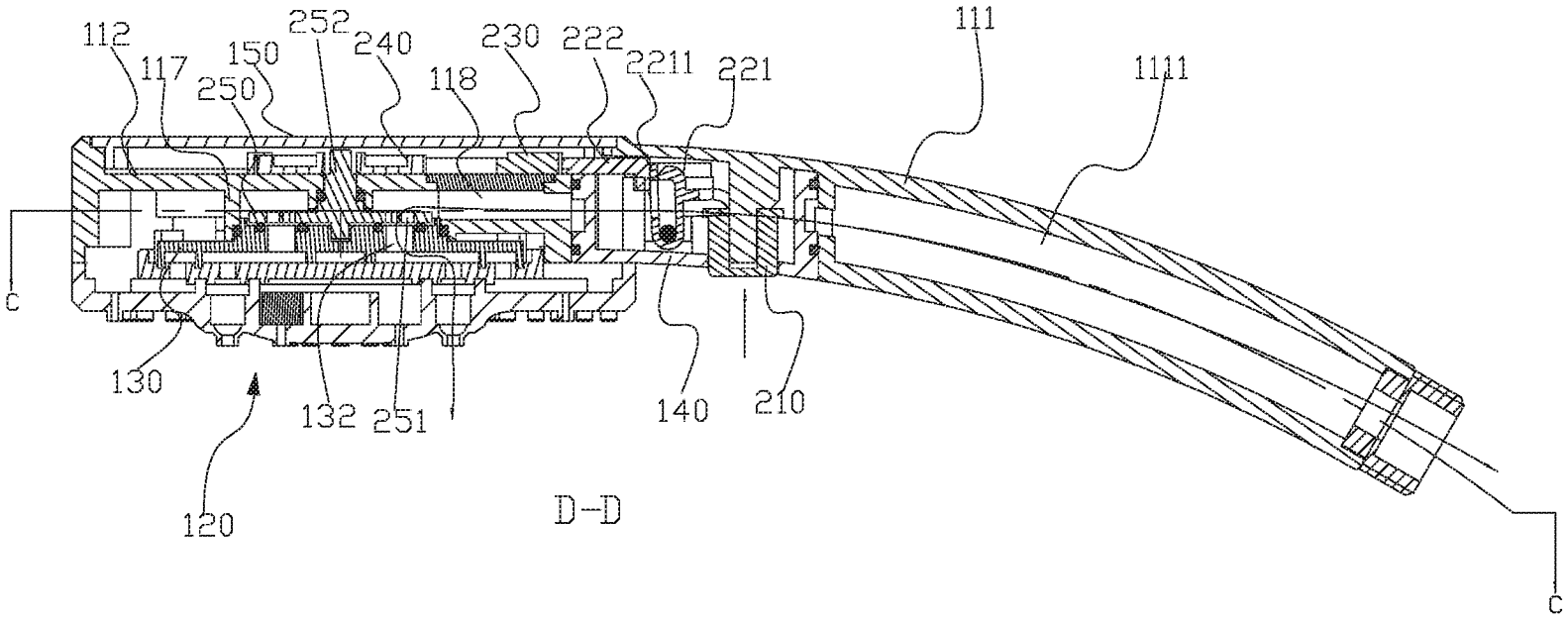
FIG. 10 shows the cutaway view of FIG. 11 D-D.
Figure 11:
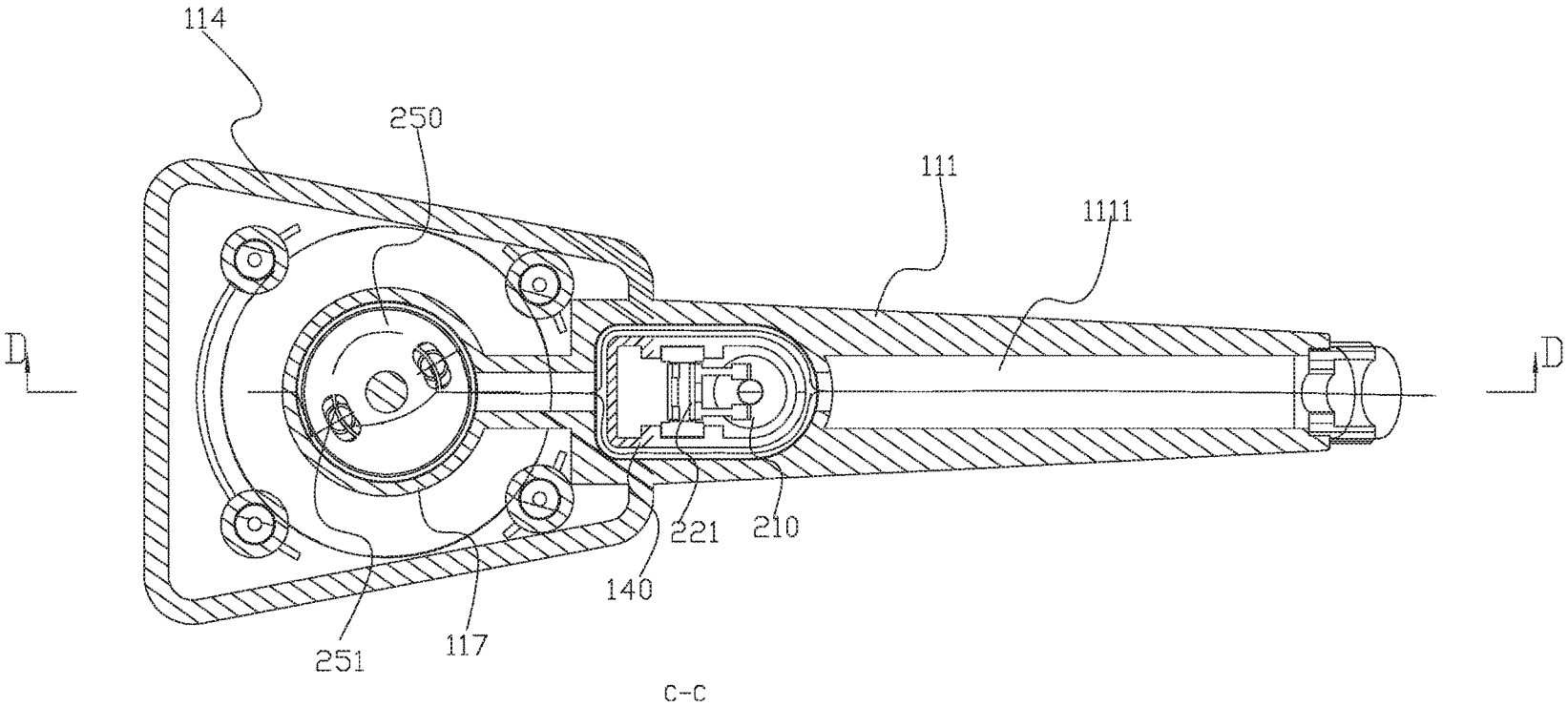
FIG. 11 shows the cutaway view of FIG. 10 C-C.

Step 4 The ratchet wheel 240 rotates and drives the water diversion disc 250 rotate, and then outlet hole 251 leaves the first water diversion hole 132, and then the water diversion disc 250 rotates in place, and then the outlet hole 251 of the water diversion disc 250 is aligned at and communicated with the second water diversion hole 132, and then water comes out of the second outlet function of the shower, the water diversion disc 250 finishes the switching of the outlet functions, at the same time, the stopping claw 233 of the pawl 230 is against the ratch of the ratchet wheel 240 for stopping the inversion of the ratchet wheel 240, according to FIG. 9, FIG. 10 and FIG. 11, water flows along the water resource, the hollow hole 1111 of the handle 111, the communicating channel 118, inlet cavity, outlet hole 251, the second water diversion hole 132 and the second cavity in turn at the moment.

Step 5 The button 210 is loosened, and then the button 210 resets, the elastic energy of the elastic claw 232 is released and drive the pawl 230 reset, the stopping claw 233 of the pawl 230 against the ratch of the ratchet wheel 240 at the moment.

The invention has been described with reference to the preferred embodiments mentioned above; therefore it can't limit the reference implementation of the invention. It is obvious to a person skilled in the art that structural modification and changes can be carried out without leaving the scope of the claims hereinafter and the description above.

INDUSTRIAL APPLICABILITY

The present invention discloses a button switching shower and its switching method. The pawl is driven to rotate by pressing the button, the rotation of the ratchet wheel is controlled by the rotation of the pawl, the ratchet wheel drives the water diversion disc rotate, and then the switch of the outlet functions is achieved by the rotation between the water diversion disc and the fixed unit. The present invention achieves the automatic positioning with easy switching, stable structure, low force for switching and good switching feeling, because of that, the present invention has good industrial applicability.

What is claimed is:

1. Button switching shower comprises a fixed unit and a switching mechanism, and at least two outlet functions are arranged in the fixed unit, wherein, the switching mechanism comprises a button that is slidingly connected to the fixed unit;

a pawl that is rotationally connected to the fixed unit, and being provided with a linking seat and a control end, and a transmission connection relationship being formed by the linking seat and the button, so that the button can act on the linking seat to drive the pawl to rotate;

a ratchet wheel rotationally connected to the fixed unit, and being connected to the control end of the pawl, so that the control end of the pawl can drive the ratchet wheel to rotate;

a water diversion disc rotationally arranged in the fixed unit, a synchronous rotation connection relationship being formed by the water diversion disc and the ratchet wheel, so that the ratchet wheel can drive the water diversion disc to rotate, and the outlet functions being switched by the relative rotation of the water diversion disc to the fixed unit;

wherein, the button switching shower further comprises an elastic claw, and two limited posts, the pawl is also provided with the elastic claw that is clamped between the two limited posts that are arranged in the fixed unit for resetting the pawl;

wherein, the button is provided with an outer end that is extended outside for the user's pressing and an inner end that is in the fixed unit; a transmission mechanism is arranged between the button and the linking seat of the pawl, the transmission mechanism comprises:

a deviator that is pivotally arranged in the fixed unit, is provided with a pivot joint part, and a pushing groove and an ejector rod are arranged at the two sides of the pivot joint part, and the ejector rod is adaptive to the inner end of the button, so that the inner end of the button can act on the ejector rod for driving the deviator to rotate;

a connecting rod, two ends of the connecting rod are against the pushing groove of the deviator and the linking seat of the pawl respectively, and the movement of the pushing groove can be transmitted to the movement of the linking seat through the connecting rod;

wherein, the fixed unit comprises a body, a water diversion body, water diversion holes, a clearance and an outlet terminal, the outlet terminal being fixedly connected below the body with a plurality of outlet functions, the water diversion body being between the body and the outlet terminal, the clearance being in a space between the body and the outlet terminal, and a cylindrical inlet cavity that is in fluid communication with the water resource is formed by the water diversion body and the body;

the water diversion holes correspond one-to-one to the outlet functions and are arranged in a part of the water diversion body corresponding to the cylindrical inlet cavity, and an outlet hole being arranged on the water diversion disc;

the water diversion disc is rotationally mounted in the cylindrical inlet cavity, the water diversion disc and the water diversion body can be hermetically connected to each other and rotate relatively, one of several groups of the water diversion holes and the inlet cavity are communicates with the outlet hole through the rotation of the water diversion disc.

2. The switching method of the button switching shower as in claim 1, comprising:

Step 1, the button that is slidingly connected to the shower is pressed, and then the button slides relatively;

Step 2, the button acts on the linking seat of the pawl for driving the pawl rotate;

Step 3, the rotation of the pawl drives the ratchet wheel rotate through the control end of the pawl, and the shape of the elastic claw of the pawl is changed for restoring energy at the same time;

Step 4, the rotation of the ratchet wheel drives the water diversion disc rotate, and then the water diversion disc is in place, and then the switching of the outlet functions is achieved by the water diversion disc, a stopping claw of the pawl is against a ratch of the ratchet wheel for stopping the inversion of the ratchet wheel at the same time;

Step 5, the pressing is loosened for resetting the button, and the elastic energy of the elastic claw is released for resetting the pawl.

* * * * *